United States Patent [19]

Fler

[11] 4,370,007

[45] Jan. 25, 1983

[54] SLIDING DRAWER SUSPENSION

[75] Inventor: Jack P. Fler, Kitchener, Canada

[73] Assignee: Jacmorr Manufacturing Limited, Kitchener, Canada

[21] Appl. No.: 231,496

[22] Filed: Feb. 4, 1981

Related U.S. Application Data

[60] Division of Ser. No. 10,419, Feb. 8, 1979, Pat. No. 4,272,139, which is a continuation-in-part of Ser. No. 941,585, Sep. 12, 1978, abandoned.

[51] Int. Cl.[3] ..... A47B 88/00; F16C 29/00

[52] U.S. Cl. ..... 312/334; 312/333; 312/341 R; 312/348; 312/350; 308/3.8

[58] Field of Search ..... 312/348, 334, 333, 339, 312/341 R, 342; 308/3.8, 3.6

[56] References Cited

U.S. PATENT DOCUMENTS

| | | | |
|---|---|---|---|
| 844,447 | 2/1907 | Gautier | 312/342 |
| 2,350,228 | 5/1944 | Hanes | 312/341 NR |
| 2,606,090 | 8/1952 | Straubel | 308/3.8 |
| 2,614,022 | 10/1952 | Kurtzon | 312/339 |
| 2,671,699 | 3/1954 | Vignos | 308/3.8 |
| 2,728,626 | 12/1955 | Gussack | 312/348 |
| 2,739,027 | 3/1956 | Gussack | 312/333 |
| 2,805,106 | 9/1957 | Penkala | 312/341 R |
| 2,810,062 | 10/1957 | Kaunitz | 308/3.6 |
| 3,186,772 | 6/1965 | Cohn | 308/3.8 |
| 3,203,749 | 8/1965 | Bullock et al. | 312/339 |
| 3,205,025 | 9/1965 | Jordan | 308/3.8 |
| 3,371,968 | 3/1968 | Loake | 312/339 |
| 3,431,042 | 3/1969 | Pipe | 312/339 |
| 3,451,730 | 6/1969 | Krispinsky et al. | 312/339 |
| 3,488,097 | 1/1970 | Fall | 312/348 |
| 3,588,198 | 6/1971 | Stewart | 312/339 |
| 3,700,301 | 10/1972 | Boeck | 312/333 |
| 3,738,716 | 6/1973 | Lambert | 312/339 |
| 3,771,849 | 11/1973 | Barber | 312/350 |
| 3,778,120 | 12/1973 | Hagen et al. | 308/3.8 |
| 3,904,254 | 9/1975 | Hagen et al. | 312/348 |
| 3,937,531 | 2/1976 | Hagen et al. | 312/348 |
| 3,975,063 | 8/1976 | Mahotka et al. | 308/3.8 |
| 4,004,841 | 1/1977 | Van Der Ley | 312/348 |
| 4,018,488 | 4/1977 | Manson | 312/348 |
| 4,025,138 | 5/1977 | Kittle | 312/334 |
| 4,067,632 | 1/1978 | Sekerich | 312/348 |

FOREIGN PATENT DOCUMENTS

| | | | |
|---|---|---|---|
| 1006214 | 3/1977 | Canada . | |
| 2721231 | 11/1978 | Fed. Rep. of Germany | 312/334 |

OTHER PUBLICATIONS

Accuride Slide, just a sample sketch, no date given.

*Primary Examiner*—Victor N. Sakran
*Attorney, Agent, or Firm*—Ridout & Maybee

[57] ABSTRACT

Suspension for a sliding drawer having a channel-section outer rail, a channel-section intermediate rail nested within the channel of the outer rail and sliding on a linear bearing, and an inner channel-section rail nested within the channel of the intermediate rail and sliding relative to it on a linear bearing. A flexible latch latches the inner rail to the intermediate rail during initial opening movement of the suspension so that the nested inner and intermediate rails reinforce one another and provide a stronger support. The latching also synchronizes the movements of the rails on opposite sides of the drawer and reduces problems associated with displacements of the bearings on opposite sides of the drawer.

15 Claims, 12 Drawing Figures

SLIDING DRAWER SUSPENSION

CROSS-REFERENCE TO RELATED APPLICATION

This application is a division of my application Ser. No. 010,419 filed Feb. 8, 1979 (issued as U.S. Pat. No. 4,272,139 dated June 9, 1981) which was a continuation-in-part of my application Ser. No. 941,585 filed Sept. 12, 1978 (now abandoned).

BACKGROUND OF THE INVENTION

This invention relates to sliding drawer suspensions for drawers for filing cabinets and the like and more especially to three-part suspensions permitting full extension of the drawer, and having an intermediate rail and two other rails for attachment to the drawer and to the cabinet, respectively. For convenience of description, said two other rails will be referred to as the inner and outer rails. The suspension also includes linear ball-bearings interposed between the outer rail and the intermediate rail and between the intermediate rail and the inner rail.

In known suspensions, all three rails have been formed as sturdy structural members of relatively large width, and this increases the costs of the materials required for fabricating the structure. In known arrangements, it has also been common to yoke two intermediate rails on opposite sides of the drawer together, or to employ friction wheels or disks journalled on the intermediate rail and frictionally engaging tracks on the outer rail and inner rail respectively, whereby the movements of the two intermediate rails on opposite sides of the drawer are synchronized, so that problems of grinding wear of the ball-bearings resulting from random movements of the intermediate rails are reduced. These expedients add to the complexity and costs of the suspension, and the friction wheels or disks are liable to slippage and wear.

SUMMARY OF THE INVENTION

The above-noted and other disadvantages of known suspensions are reduced or avoided in the suspension of the invention wherein a compact and relatively simple structure is provided. The suspension comprises an outer channel-section rail, an intermediate channel section rail nesting within the channel of the outer rail, and an inner channel rail nesting within the channel of the intermediate rail, linear ball-bearings interposed between the outer and intermediate rails and between the intermediate and outer rails, and latching means releasably latching the inner and intermediate rails together in nested relationship.

This invention is based on the observations that in the most common mode of use of sliding drawers, the drawer is opened only part way and only the front part of the drawer is made use of. With the above arrangement, the drawer is carried during partial opening of the drawer on a supporting arm constituted by the latched-together inner and intermediate rails, providing a stronger support that is less liable to wear and less vulnerable to accidental damage. It will be noted that the suspension of the invention is compact and the intermediate and inner rails are of small width relative to the outer rail, with the intermediate and inner rails in nested relationship with one another and with the outer rail.

As the movements of the intermediate rails are synchronized during the most-frequently occurring initial extension movement of the suspension by being latched to their respective inner rails, problems of the drawers jamming as a result of displacements of the ball-bearings can also be reduced. In the preferred form, abutment members are provided for shifting displaced ball bearings to the desired central position when the drawer is closed.

BRIEF DESCRIPTION OF THE DRAWINGS

Two examples of suspensions in accordance with the invention will now be described in more detail with reference to the accompanying drawings in which.

DESCRIPTION OF THE PREFERRED EMBODIMENT

Figure 1:
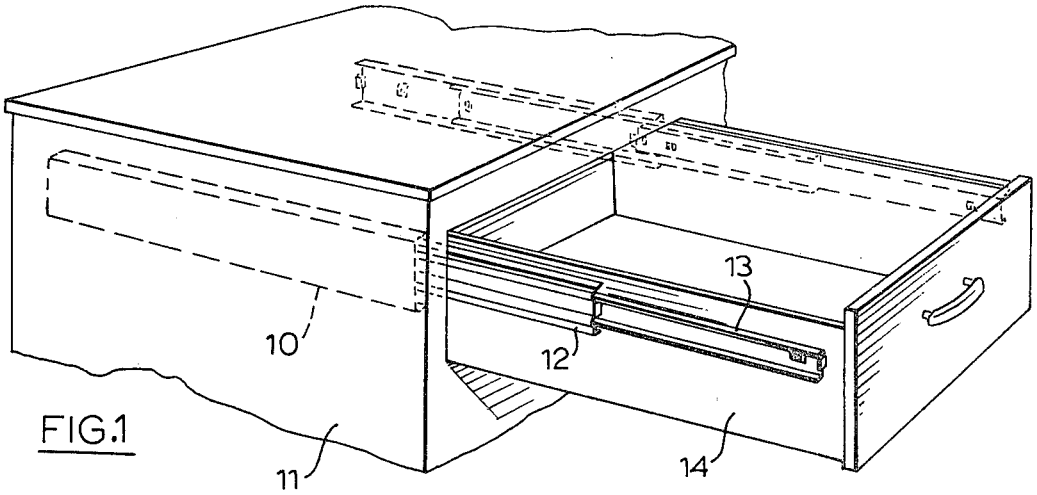
FIG. 1 is a perspective view of a cabinet with a sliding drawer carried on a suspension in accordance with the invention.

Referring to the drawings, wherein like reference numerals refer to like parts a three-part suspension comprises an outer rail 10, which in use, as illustrated in FIG. 1, is intended to be fastened on the inner wall of a cabinet 11 with conventional fasteners. The suspension also comprises an intermediate rail 12, and an inner rail 13 which is connected on the side of a sliding drawer 14 with conventional fasteners.

Figure 3:
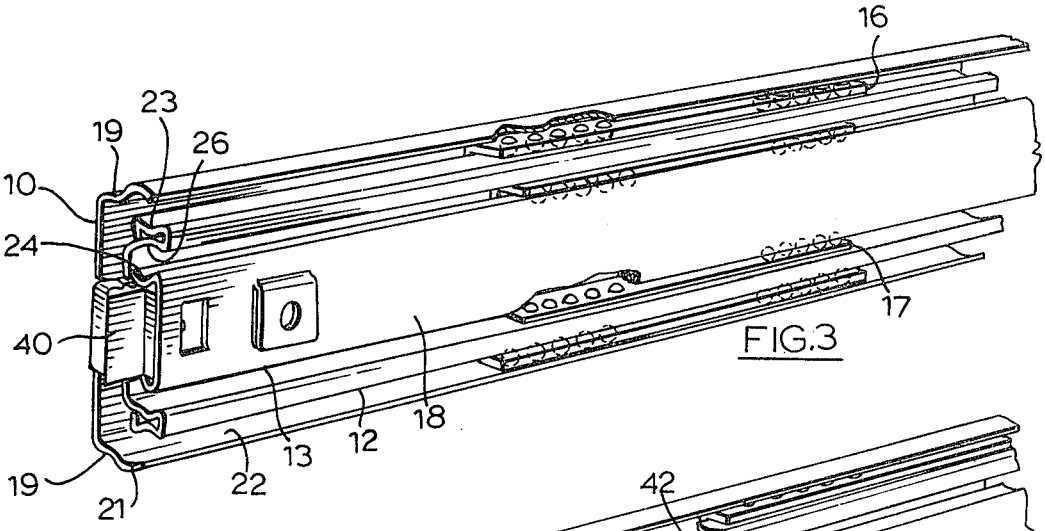
FIG. 3 is a fragmentary perspective view from the inner side of the suspension of FIG. 2, showing the suspension in closed position.
Figures 2, 5, 6, 7:
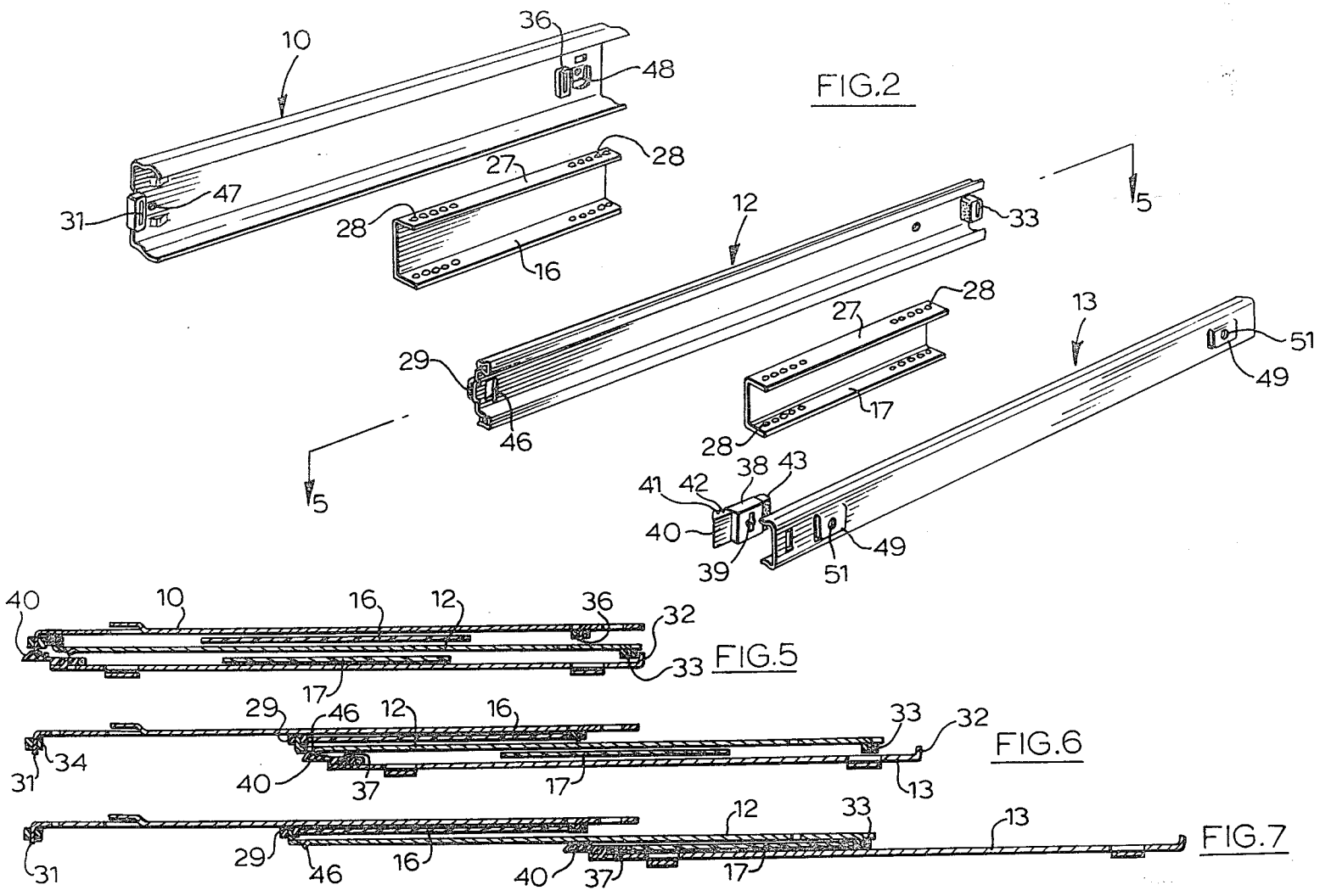
FIG. 2 is an exploded view of a first form of drawer suspension.
FIG. 5 is a section through a completely closed suspension, taken on the line 5—5 of FIG. 2.
FIGS. 6 and 7 are views similar to FIG. 5, illustrating the suspension in successive stages of extension.

As shown in more detail in FIGS. 2 and 3, an outer linear bearing 16 is interposed between rails 10 and 12, and an inner linear bearing 17 is interposed between rails 12 and 13. Each of the rails, 10, 12, and 13 is of channel-section. It will be noted that the channel of rail 13 is reversed as compared with the channels of rails 10 and 12, so that the generally flat channel bottom 18 of the rail 13 faces inwardly, for convenience of attachment of the rail 13 to the sides of the drawer 14.

The outer rail 10 has channel sides 19 that terminate in re-entrant edge portions 21 defining a longitudinally extending recess 22. Similarly, the intermediate rail 12 has sides that are formed to provide a longitudinally extending arcuate-section recess 23 on its outer face, opposite the recess 22. As can best be seen in FIG. 3, these recesses 22 and 23 retain the balls of the outer linear bearing 16, preventing the intermediate rail from being disengaged laterally from its nested position between the sides 19 of the outer rail 10.

Similarly, the channel sides of the inner rail 13 are formed to provide an arcuate-section longitudinal recess 24, and this co-operates with a longitudinal recess 26 formed in the inner face of the channel side of the intermediate channel 12, thus trapping the balls of the inner linear bearing 17 and preventing lateral disengagement of the inner rail 13 from the intermediate rail 12.

It will be appreciated that the longitudinal recesses 22, 23, 24, and 26 also provide track surfaces for the balls of the linear bearings 16 and 17, permitting free longitudinal sliding of the intermediate and inner rails 12 and 13 relative to the outer rail 10.

Each of the bearings 16 and 17 is formed as a channel-section cage 27, which may be molded from tough plastics, the channel sides of which are provided with perforations which locate the balls 28. The balls 28 are arranged in groups adjacent each end of the sides of the channel 27. It is found that this provides an easier rolling motion than is achieved with the more conventional arrangement in which the balls are regularly distributed longitudinally of the cage. It appears that by clustering the balls in a group, the load on the bearing is more uniformly distributed through each of the balls, and there is less tendency for the full load to be imposed upon one or two balls of the bearing as a result of any bending or warping of the surfaces of the rails 10, 12, and 13. In any event, it is found that the grouping of balls adjacent each end of the bearing cage results in greater stability and diminishes any tendency for sticking or binding of the bearings.

Referring to FIG. 2 and FIGS. 5 to 7, these illustrate in more detail the arrangement of stops that limit the extent of forward and rearward travel of the rails. Rearward closing movement of the intermediate rail 12 with respect to the outer rail 10 is limited by engagement of a stop member 29 on the intermediate channel 12 at its end which is inserted rearmost into the cabinet 11, with a correspondingly positioned stop member 31 on the outer rail 10. Rearward movement of the inner rail 13 with respect to the intermediate rail 12 is limited by engagement of a stop member 32 on the front end of the inner rail 13 engaging with a stop member 33 on the front end of the adjacent side of the intermediate rail 12. Conveniently, as illustrated in the drawings, these stop members 29, 31, 32 and 33 are formed by relatively narrow tabs of metal bent upwardly from the material of the rails 10, 12, and 13. These tabs can be bent upwardly after the suspension has been assembled by slidingly inserting the rails 12 and 13, together with the bearings 16 and 17 in their proper arrangement within the outer rail 10. To reduce wear, and make the operation of the suspension as soundless as possible, these tabs are protected by resilient, e.g. rubber, protective bumper sleeves applied over the tabs. One of the rubber bumpers 34 forming part of the stop member 31 on the rear end of outer rail 10 is shown in more detail in FIG. 4.

The maximum forward extension of the intermediate and inner rails 12 and 13 is controlled by engagement of the bearing cages 16 and 17 against stop members. As best illustrated in FIG. 7, forward extension of the intermediate rail 12 is limited by engagement of the stop member 29 on the rear end of the bearing cage 27 of the outer bearing 16 at the same time that the front edge of this cage 27 engages on a stop member 36 formed on the adjacent side at the front end of the outer rail 10. Forward extension of the inner rail 13 is limited by a stop member 37 on the outer side of the rear end of the inner rail member 13 engaging the cage of inner bearing 17 at the same time as the forward travel of the cage of this bearing 17 is itself limited by engagement against the stop member 33. As with the stop members 29, 31, 32, and 33, the stop members 36 and 37 can conveniently be provided by bending up narrow tabs of metal from the material of the rails 10 and 13, respectively, and these tabs are likewise in the illustrated example protected by a resilient bumper or cushion.

As can be seen in the drawings, the tabs constituting the stop members 31, 32, 33, 36, and 37 are disposed centrally of the channel bottoms of the channels of the rails 10, 12, and 13, and the provision of these bent up tabs provides a relatively simple and mechanically strong means of limiting the relative movements of the rails of the suspension.

The rear end of the inner rail 13 is provided with a flexible latch member for latching onto the intermediate rail 12, so that during the initial opening and rearward extension of the suspension, the intermediate and inner rails 12 and 13 move together. This latching member comprises a molding of wear-resistent flexible plastics material, e.g. polyurethane, and in the example illustrated the molding comprises a body portion 38 provided with a slot 39 in its outer surface which receives the bent up metal tab that constitutes the stop member 37. The plastic of the body member 38 may be attached more securely onto the tab 37 by means of an adhesive or the like.

Rearwardly from the body portion 38, there extends a flexible tongue portion which is formed adjacent its leading edge with a first transverse groove 41. Between the groove 41 and the body portion 38, the tongue is provided with a second transverse groove 42 which forms a hinge about which the leading portion of the tongue portion 40 can pivot. The depth to which the groove 42 is formed determines the hinging characteristics of the tongue portion 40.

It will be noted from FIG. 2 that a rubber bumper pad 43 is attached e.g. by an adhesive on the forward side of the body portion 38, and it is this rubber bumper 43 that contacts the rearward edge of the cage 27 of the bearing 17 at the limit of forward extent of the inner rail 13.

Figure 4:
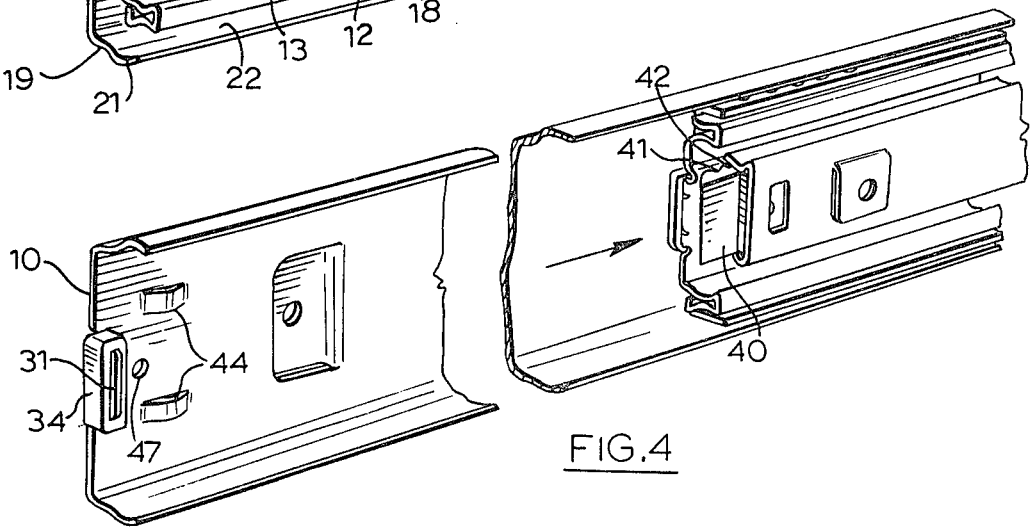
FIG. 4 is a fragmentary perspective view similar to FIG. 3, illustrating the suspension in partially extended position.

The flexible latch member provided by the tongue 41 serves, in the present example, the dual function of latching the suspension releasably in a fully closed position, as illustrated in FIG. 5, as well as serving as a latch releasably retaining the intermediate and inner rails 12 and 13 together during the initial opening movement of the suspension. The metal tab 31 that constitutes the stop member at the rear end of the outer rail 10 projects above the upper surface of the rubber bumper 34, to provide a transversely extending metal edge, and the tongue portion 40 of the latch member extends sufficiently rearwardly, that in the limiting fully closed position of the inner rail 13, as limited by engagement of the stop members 32 and 33, the groove 41 on the latch member 40 engages on the transverse edge of the tab 31, as shown in FIG. 5, and releasably retains the suspension and the drawer in the fully closed position. In this position, the tongue portion 40 is lightly deflected from its normal position, so that the groove 41 is lightly engaged on the transverse edge of the tab 31 owing to the resilience of the plastic of the latch member. As it is desired that the latch member 40 should be disengageable from the tab 31 on the application of moderate force applied by hand to the handle of the drawer 14, the groove 41 is made relatively shallow, so that the need to apply undue force, which would lead to rapid wearing of the plastic of the tongue 40 is avoided. For this reason, it is important that in the fully closed position of the suspension, the intermediate rail 12 is held parallel with the channel bottom of the outer rail 10. However, owing to the loading applied to the suspension by the weight of the drawer and its contents, the intermediate and inner rails 12 and 13 may tend to become tilted about their longitudinal medial axes, and in this condition only a lower corner of the groove 41 may engage on the tab 31. The engagement of a corner portion of the groove 41 with the tab 31 may be insufficient to retain the drawer 14 in closed position, especially if the drawer 14 is heavily loaded and the cabinet 11 may be tilted forwardly owing to an uneven floor surface. This problem is avoided in the structure shown in the drawings by providing a cam surface adjacent the rear end of the outer rail 10 on the side adjacent the intermediate rail 12, and in the example illustrated this cam surface comprises two raised portions 44 that are struck from the metal of the outer rail 10, as best seen in FIG. 4. The front sides of these portions 44 provide sloping ramp surfaces that engage the adjacent outer face of the channel bottom of the intermediate rail 12 when the latter is moved rearwardly toward its fully closed position illustrated in FIG. 5. Thus, these portions 44 push the intermediate rail 12, together with the bearing 16 laterally away from the outer rail 10, to the maximum extent permitted by the re-entrant edge portions 21 on the channel sides of the outer rail 10. This therefore holds the intermediate rail 12 in parallel alignment with the outer rail 10, and counteracts any tendency of the intermediate rail 12 to tilt about its longitudinal horizontal axis.

The second function of the latch member 40 is to latch the intermediate and inner rails 12 and 13 together, and for this purpose, the intermediate rail 12 is provided with a projection on the side adjacent the inner rail 13 adjacent the rear end of the intermediate rail 12. As shown in FIG. 2, this projection in the preferred form comprises a metal tab portion 46 struck from the metal of the intermediate rail 12, and inclining slightly rearwardly, and providing a transverse edge at its free end on which the groove 41 of the latch member 40 can engage.

In use, when the drawer is in the fully closed position, the latch member 40 engages on the metal tab 31, as described in more detail above, so that the suspension is lightly retained in the fully retracted or closed position, and light hand pressure is required to disengage the suspension from its latched closed position.

Immediately after the latch member 40 is disengaged from the tab 31, the latch member 40 engages with its groove 41 on the transverse edge of the tab member 46 on the intermediate rail, so that during the continued opening movement of the suspension, the intermediate and inner rails 12 and 13 are latched together and move as a unit forwardly to the position shown in FIG. 6, at which abutment of the stops 29 and 36 on opposite edges of the cage 27 of the bearing 16 prevents further forward movement of the intermediate rail 12 relative to the outer rail 10. At this point, the tongue member 40 is deflected laterally, so that it disengages from the tab 46, and the inner rail 13 can be moved forwardly relative to the intermediate rail 12 to its position of maximum forward extent as illustrated in FIG. 7. In this position, further forward movement is prevented by the bumper 43 of the stop 37 and the stop 33 on the intermediate rail engaging on opposite edges of the cage of the bearing 17.

It will be noted that during the initial opening movement of the drawer, the weight of the drawer is supported by the latched together intermediate and inner rails 12 and 13, which serve to reinforce one another as long as the inner rail 13 is retained in nested relationship within the channel of the intermediate rail 12.

During the return motion of the drawer, the intermediate rails 12 on opposite sides of the drawer may move randomly with respect to one another if the drawer has been opened to an extent sufficient to disengage the latch member 40 from the tab 46 on the intermediate rail 12, but it will be noted that if the drawer has been opened only part way the intermediate and inner rails 12 and 13 will remain latched together and will move in synchronization on opposite sides of the drawer up to the point where after the intermediate rail 12 has reached its limit of rearward movement on engagement of the stop member 29 on the stop member 31 of the outer rail, the latch 40 will disengage from the tab 46 on the intermediate rail 12 for a brief period before re-engaging once more on the tab 31 on the outer rail 10, so as to retain the drawer in closed position.

The arrangement shown in the drawings can reduce problems of jamming of the movement of the drawer as a result of displacements of the linear ball bearings 16 and 17 from their desired positions centrally of the stop member pairs 29 and 36, and 33 and 37, respectively. If the intermediate rails 12 on opposite sides of the drawer are allowed to float in random motion relative to one another during partial forward and rearward motion of the drawer, there is a tendency for the bearings 16 and 17 to creep from their proper position aligned midway between the stop member pairs 29 and 36 on the one hand that control the maximum forward movement of the intermediate rail 12 and the stop member pairs 33 and 37 controlling the maximum forward extension of the inner rail 13 on the other. When this occurs premature engagement of one of the pair of stop members 20 and 36 on the cage of the outer bearing 16 or of one of the pair of stop members 33 or 37 on the cage of the inner bearing 17 takes place, and interferes with further extension of the suspension to the fully opened position. The defect can be remedied only by applying considerable force tending to open the drawer so as to drag one rail relative to the displaced bearing, with the rail rubbing against the surfaces of the balls of the bearing.

This defect is especially serious where, as in the present example, the two linear bearings 16 and 17 permit different extents of maximum travel of the rails that slide on them. Thus, for example, with reference to FIG. 5, it will be seen that in the fully closed position the distance between the cage of the bearing 16 and stop 36 is somewhat smaller than the distance between the cage of the bearing 17 and the stop 33, so that a somewhat greater extent of maximum travel of the inner rail 13 relative to the intermediate rail 12 is permitted than the extent of relative travel permitted between the intermediate rail 12 relative to the outer rail 10. With this kind of suspension arrangement, if the bearings 16 and 17 become unevenly misaligned on opposite sides of the drawer, the suspension on one side of the drawer will stick or bind at a different extent of opening from the suspension on the opposite side of the drawer, so that on attempting to free the drawer by pulling it forcefully outwards, a lateral bending moment tends to be exerted, which adds further to the grinding wear of the balls of the bearings 16 and 17, and leads to the possibility of the connections between the suspension rails and the cabinet and drawer being damaged and of the suspension rails becoming permanently bent.

However, with the arrangement of the invention, in which during the initial opening of the drawer the inner and intermediate slides 13 and 12 are latched together, any displacements of the bearings that result from random movements of the intermediate rails relative to the outer and inner rails will be avoided. Moreover, when the drawer is partially opened and is moved forwardly and rearwardly without fully opening or closing it, which is the mode of use of the drawer in which the above mentioned displacements are most likely to occur, any displacements that result will, in the first place, be confined only to the linear bearing 16, and any displacements that may result will tend to be uniform on each side of the drawer, whereby these displacements, if they accumulate to sufficient extent that the full opening of the drawer is impeded, can be removed by fully opening the drawer without any tendency for bending moments to be applied to the drawer suspension.

In the example illustrated in FIGS. 8 to 12, the outer and intermediate rails 10 and 12 are provided with means for positively centering the cage of the outer bearing at a desired position approximately midway between the pair of stop members that limits the forward extension of the intermediate rail 12.

Figure 9:
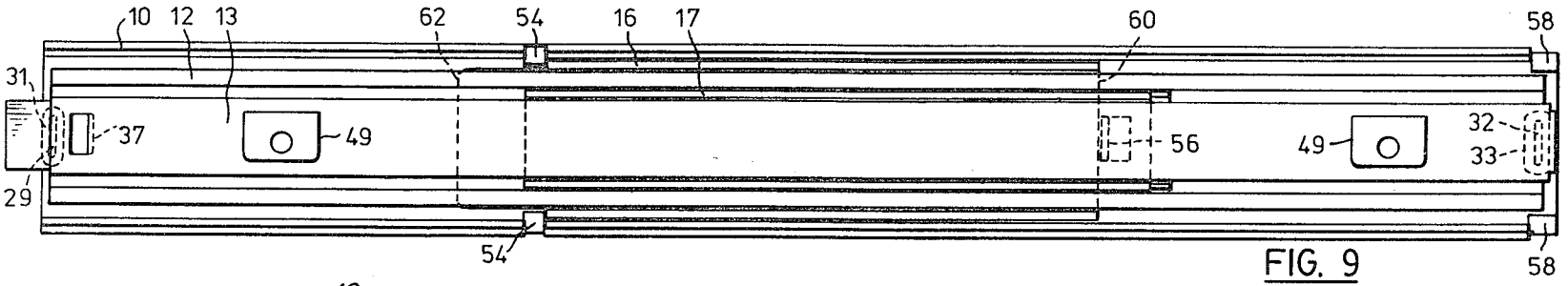
FIG. 9 is a view from the front of the suspension of FIG. 8 in fully retracted position.

These centering means comprise an abutment member 52 on the outer rail 10, which in the example illustrated, is afforded by two inwardly-curled tabs 54 struck from the metal of channel side walls 19 of the rail 10. In the fully retracted position, as illustrated in FIG. 9, these tabs 54 engage the rear edge of the channel sides of the channel-section cage of the outer bearing 16. Further, the intermediate rail 12 is provided with a cooperating abutment member in the form of a tab 56 projecting on the side of the intermediate rail 12 adjacent the bearing 16.

In order to avoid interfering with the tab 56, the stop member that limits forward travel of the bearing 16, corresponding to the stop member 36 of the embodiment of FIGS. 1 to 8, is in this instance formed, similarly to the inwardly-curled tabs 54, as inwardly curling tabs 58 on the front end of the outer rail 10.

In operation, on closure of the suspension to the fully retracted position as illustrated in FIG. 9, any forward or rearward displacements of the bearing 16 relative to its proper position midway between the pair of stop members 29 and 58 is corrected by the rear edge 60 of the web portion of the bearing 16 engaging on the abutment member 56 or the rear edges of channel sides of the bearing 16 engaging on the abutment members 56, so that the bearing 16 is positively shifted to its proper central position.

Engagement of the bearing 16 with the abutment member 54 or 56 interferes with the free rearward movement of the intermediate rail, and hand pressure has to be exerted to drag the bearing forcefully in non-rolling motion relative to the outer or intermediate rail 10 or 12. However, as large displacements are likely to accumulate only during the period in which the drawer is opened part way and is moved forwardly and rearwardly through small distances, with the intermediate and inner rails 12 and 13 latched together, the rails mutually reinforce one another when pressure is applied on the drawer to close it, owing to the latching together of the intermediate and inner rails, and if the bearings 16 on opposite sides of the drawer are misaligned, pushing forcefully on the drawer at a point where the drawer is close to its fully closed position is less liable to cause damage to the suspension rails and their connections to the cabinet and drawer than exerting a corresponding outward pull, as in the latter case a considerable bending moment may be applied.

Figure 10:
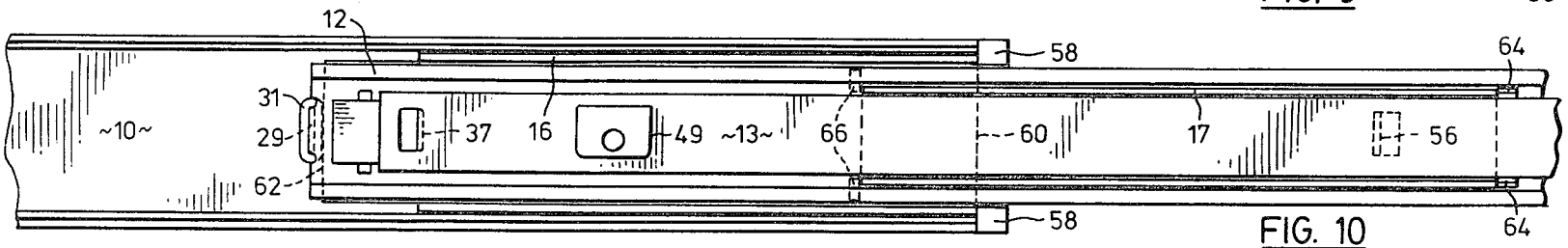
FIGS. 10 and 11 are fragmentary views from the front illustrating successive stages in the extension of the suspension to the open position.
Figure 11:
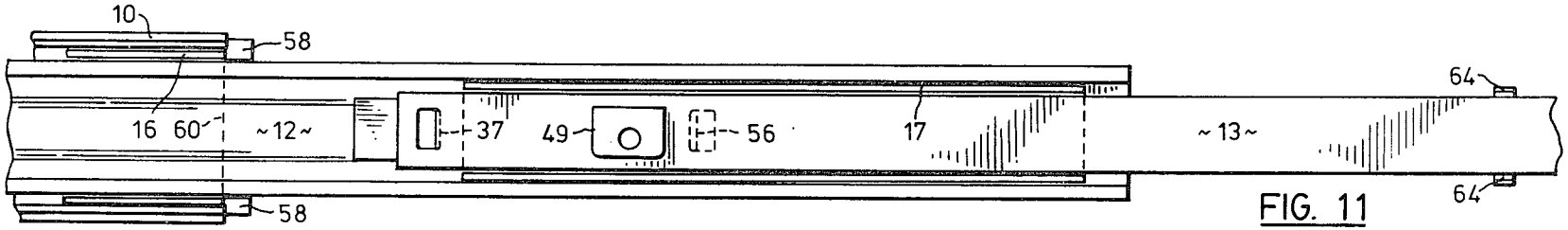
Figure 12:
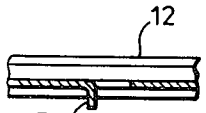
FIG. 12 shows a section on the line XII—XII of FIG. 8.

In the example illustrated in FIGS. 8 to 12, the cage of the outer bearing 16 includes an extension 62 extending from the ends of the channel sides of the cage 27 at the rearward end of the bearing cage. The maximum extent of forward travel of the intermediate rail 12 is therefore limited by the extension 62 and the remainder of the cage 27 of the bearing 16 being engaged between the pair of stop members 29 and 58, as shown in FIG. 10. The extent of maximum travel of the intermediate rail 12 rearwardly relative to the outer rail 10 is determined by engagement of the stop members 29 and 31, and not by the abutment members 54 and 56 engaging the bearing 16 so as to avoid undue force being exerted on the cage of the bearing 16. This is achieved by having the abutment members 54 and 56 spaced apart at a distance such that there is some clearance between them and the cooperating surfaces of the cage of the bearing 16, i.e. the rearward end of the channel sides of the cage and the forward edge 60, respectively, when the intermediate rail is at its maximum extent of rearward travel as defined by engagement of its stop member 29 on the stop member on the outer rail 10. These abutment surfaces are of course arranged so that in this position the bearing 16 is located, save for the above-mentioned clearance, at a position with the rearward edge of its extension 62 and its forward edge approximately equidistant from the cooperating stops 29 and 58 respectively.

In the embodiment illustrated, a further abutment member is provided on the inner rail 13 for shifting the inner bearing 17 rearwardly to correct displacements of the inner bearing 17 toward the forward end of the intermediate and inner rails 12 and 13. This abutmemt member comprises a pair of tabs 64 struck laterally outwardly from the side walls 24 of the channel of the inner rail 13, for engagement on the forward edge of the inner bearing 17. If desired a further pair of tabs 66 may be struck laterally inwardly from the side walls of the intermediate rail 12, as indicated in broken lines in FIG. 10, so as to engage the rear edges of the bearing 17 and position it in the desired central position on closure of the drawer, with the proviso that when the inner rail 13 is pushed rearwardly into the intermediate rail 12 from the extended position shown in FIG. 11, the stop member 32 on the inner rail 13 engages the stop member 33 on the intermediate rail 12 and defines the maximum extent of rearward travel of the inner rail 13 so that in this position there is some play or clearance between the cage of the bearing 17 and the abutment members 64 and 66, so that the risk of excessive force being exerted on the cage is reduced.

Figure 8:
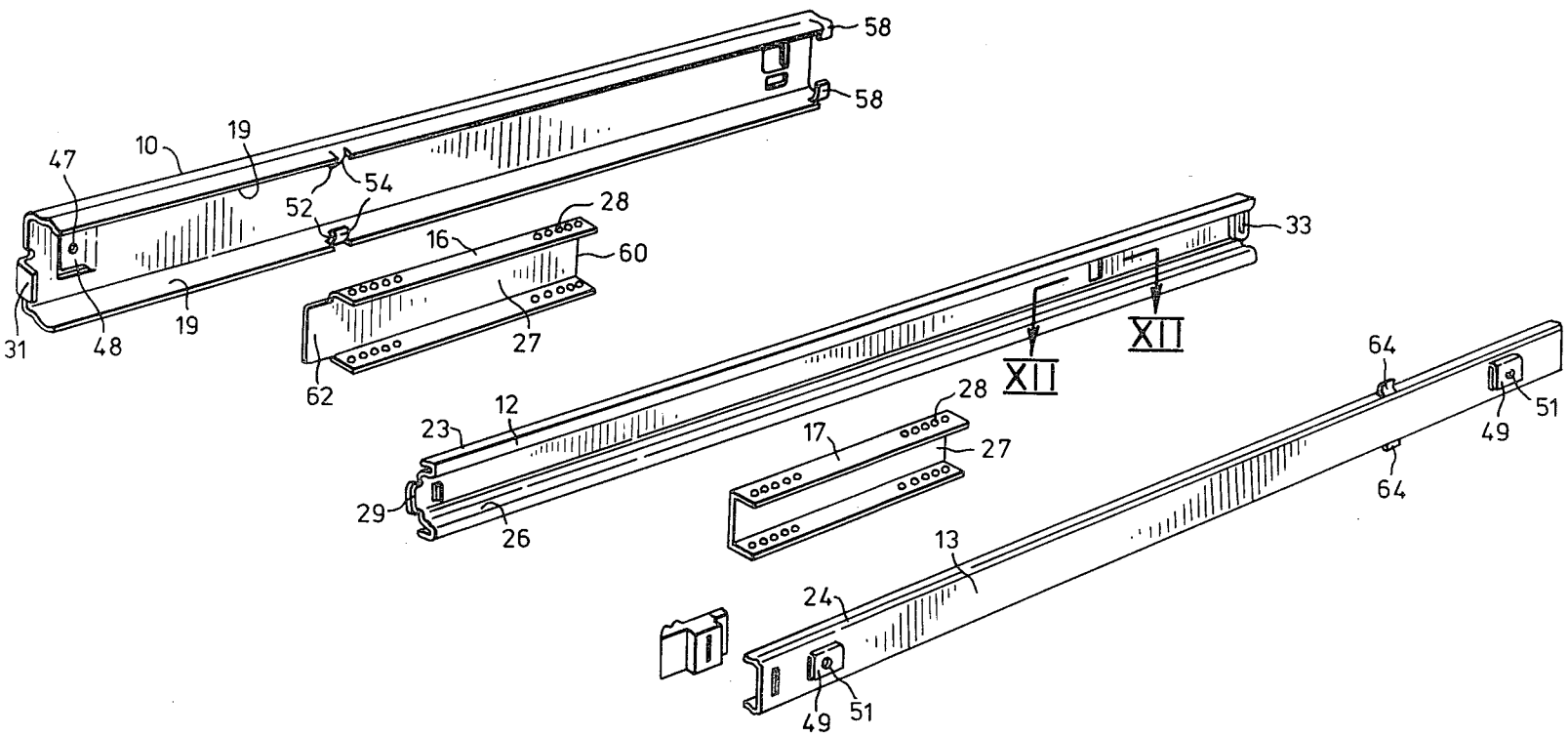
FIG. 8 is an exploded view of a second form of suspension.

Referring further to the examples shown in the drawings, it will be seen that the construction of the rails as channel section members facilitate the attachment of the suspension to the components of the cabinet and of the drawer. Thus, the outer rail 10 may be provided, as indicated in FIGS. 2 and 8 with holes 47 passed directly through the metal of the channel bottom of the rail, or through tab members 48 struck from the metal of the channel bottom. Similarly, as shown in FIGS. 2 and 8, the metal of the channel bottom of the rail 13 may be formed with struck-out tab portions 49 which may clip onto cooperating portions of the drawer 14. These tab portions 49 are also formed with holes 51 through which mechanical fasteners may be passed to secure the rail 13 to the drawer.

I claim:

1. A three-part sliding drawer suspension comprising outer, intermediate and inner channel-section rails each having channel sides and a channel bottom, outer and inner ball bearings each having a channel-section ball bearing cage having channel sides and a channel bottom between the outer and intermediate rails and between the intermediate and inner rails respectively; extension of the intermediate rail relative to the outer rail being limited by engagement of the end surfaces of the outer cage between a stop on the rear of the intermediate rail and a stop on the front of the outer rail, and retraction of the intermediate rail relative to the outer rail being limited by engagement of its rear stop with a stop on the rear of the outer rail; extension of the inner rail relative to the intermediate rail being limited by engagement of the end surfaces of the inner cage between a stop on the rear of the inner rail and a stop on the front of the intermediate rail, and retraction of the inner rail relative to the intermediate rail being limited by engagement of a stop on the front of the inner rail with the front stop on the intermediate rail; the cages being normally positioned so that the end surfaces of each cage are spaced at equal distances from the stop surfaces which they engage; abutment members on the outer rail and on the intermediate rail arranged for a small clearance between them and the rear and front ends of the outer bearing cage when in the normal position with the intermediate rail retracted relative to the outer rail, and for engaging an end of the outer cage when displaced forwardly or rearwardly from its normal position and for shifting the outer cage to its normal position on closing movement of the suspension; and an abutment member on the inner rail arranged for a small clearance between it and the front end of the inner bearing cage when in its normal position with the inner rail retracted relative to the intermediate rail, for engaging the front end of the inner cage when displaced forwardly from its normal position and for shifting the inner cage to its normal position on closing movement of the suspension; said abutment members on the outer and inner rails comprising tabs struck from the channel sides of the outer and inner rails for engaging the channel sides of the outer and inner cages, respectively, and the abutment member on the intermediate rail comprising a tab struck from the channel bottom of the intermediate rail for engaging the channel bottom of the outer cage.

2. A suspension according to claim 1 wherein the ball bearing cages each have balls concentrated in groups of regularly spaced balls adjacent each end of the cage.

3. A suspension according to claim 1 including latching means releasably latching the intermediate rail to the inner rail in the retracted position of the inner rail relative to the intermediate rail, whereby on opening movement of the suspension the intermediate rail moves together with the inner rail in latched connection thereto.

4. A suspension according to claim 1 wherein the extent of maximum travel of the intermediate rail relative to the outer rail is different from the extent of maximum travel of the inner rail relative to the intermediate rail.

5. A suspension according to claim 3 wherein the latching connection is releasable by exerting a pull longitudinally on the inner rail relative to the intermediate rail.

6. A suspension according to claim 3 wherein the latching means comprise a projection on the intermediate rail and a resiliently deflectable member on the inner rail having a recess for engaging the projection.

7. A suspension as claimed in claim 6 wherein said projection comprises a tab struck from the channel bottom of the intermediate rail.

8. A suspension as claimed in claim 7 wherein said deflectable member comprises a resilient plastics member having a body portion attached to the inner rail and a tongue portion provided with said recess.

9. A suspension as claimed in claim 6 wherein the stop on the rear of the outer rail comprises a tab bent inwardly from the channel bottom of the outer rail, and the recess on the deflectable member is adapted to releasably latch with the tab when said suspension is in the closed position.

10. A suspension as claimed in claim 9 wherein said tab has a transverse end edge, and including cam means on the adjacent end of the outer rail reacting with the intermediate rail when the latter is retracted relative to the outer rail and maintaining the intermediate rail in alignment with the outer rail for facilitating latching of said recess on the tab.

11. A suspension as claimed in claim 10 wherein the channel sides of the outer rail have re-entrant edge portions with balls associated with said outer ball bearing cage being retained between the re-entrant edges of the outer rail and the channel sides of the intermediate rail, and said cam means comprise ramp portions on the inner rail that urge said intermediate rail towards the inner side of the suspension whereby said balls are pressed toward said re-entrant edges.

12. A suspension as claimed in claim 11 wherein said ramps are projections struck from the channel bottom of the outer rail.

13. A suspension as claimed in claim 1 wherein the stop on the rear of the outer rail comprises a tab bent inwardly from the channel bottom of the outer rail, the stops on the front and on the rear of the intermediate rail each comprise a tab bent inwardly from the channel bottom of the intermediate rail, and the stops on the front and on the rear of the inner rail each comprise a tab bent inwardly from the channel bottom of the inner rail.

14. A suspension as claimed in claim 13 wherein the stop on the front of the outer rail comprises a pair of tabs each bent inwardly from the front end of a channel side of the outer rail.

15. A three-part sliding drawer suspension comprising outer, intermediate and inner channel section rails each having channel sides and a channel bottom, the intermediate rail being nested in a retracted position between the channel sides of the outer rail and having its channel opening facing away from the channel opening of the outer rail, the inner rail being nested in a retracted position between the channel sides of the intermediate rail and having its channel opening facing toward the channel opening of the inner rail, outer and inner ball bearings each having a channel-section ball bearing cage having channel sides and a channel bottom between the outer and intermediate rails and between the intermediate and inner rails, respectively; extension of the intermediate rail relative to the outer rail being limited by engagement of a rear end surface of the channel bottom of the outer cage with a rear tab bent inwardly from the rear end of the channel bottom of the intermediate rail and simultaneously therewith engagement of front end surfaces of the channel sides of the outer cage with a pair of spaced-apart front tabs each bent inwardly from the front end of the outer rail; said retracted position of the intermediate rail relative to the outer rail being defined by engagement of said rear tab on the intermediate rail with a rear tab bent inwardly from the rear end of the channel bottom of the outer rail; extension of the inner rail relative to the intermediate rail being limited by simultaneous engagement of rear and front end surfaces of the channel bottom of the inner cage with a tab bent inwardly from the rear end of the channel bottom of the inner rail and with a front tab bent inwardly from the front end of the channel bottom of the intermediate rail, respectively; said retracted position of the inner rail relative to the intermediate rail being defined by engagement of said front tab on the intermediate rail with a front tab bent inwardly from the front end of the channel bottom of the inner rail; said inner and outer cages normally being positioned so that the end surfaces of each cage are spaced at equal distances from the tabs with which they engage; a first abutment member comprising a pair of tabs each bent inwardly from a channel side of the outer rail at a point intermediate the front and rear tabs on the outer rail and a second abutment member comprising a tab bent inwardly from the channel bottom of the intermediate rail at a point intermediate the front and rear tabs on the intermediate rail, for engaging rear end surfaces of the channel sides and a front end surface of the channel bottom of the outer cage, respectively, said first and second abutment members being positioned to provide a small clearance between them and said rear end and front end surfaces of the outer cage, respectively, when in said normal position and with the intermediate rail in its retracted position, whereby said first and second abutment members engage said end surfaces of the outer cage when displaced from its normal position and shift the outer cage to its normal position on closing movement of the suspension; said tab constituting the second abutment member being positioned to pass freely through the spacing between said spaced-apart front tabs on the front end of the outer rail; and a third abutment member comprising a pair of tabs bent outwardly from the channel sides of the inner rail at a point intermediate the front and rear tabs on the inner rail for engaging front end surfaces of the channel sides of the outer cage, and positioned to provide a small clearance between the third abutment member and said front end surfaces of the inner cage when in its normal position with the inner rail in its retracted position, whereby said third abutment member engages said front end surfaces of the inner cage when displaced forwardly from its normal position and shifts it to its normal position on closing movement of the suspension.

* * * * *